US008440026B2

(12) United States Patent
Classen et al.

(10) Patent No.: US 8,440,026 B2
(45) Date of Patent: May 14, 2013

(54) DISHWASHING MACHINE EQUIPPED WITH AN OZONE STORAGE DEVICE

(75) Inventors: Egbert Classen, Wertingen (DE); Caroline Heiligenmann, Boeblingen (DE); Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1144 days.

(21) Appl. No.: 11/791,396

(22) PCT Filed: Oct. 18, 2005

(86) PCT No.: PCT/EP2005/055330

§ 371 (c)(1),
(2), (4) Date: May 23, 2007

(87) PCT Pub. No.: WO2006/061281

PCT Pub. Date: Jun. 15, 2006

(65) Prior Publication Data

US 2008/0011329 A1 Jan. 17, 2008

(30) Foreign Application Priority Data

Dec. 9, 2004 (DE) ..... 10 2004 059 420
Jan. 28, 2005 (DE) ..... 10 2005 004 091

(51) Int. Cl.
*B08B 9/20* (2006.01)

(52) U.S. Cl.
USPC ..... 134/25.2

(58) Field of Classification Search ..... 134/25.2, 134/56 D, 102.1, 102.3, 103.2
See application file for complete search history.

(56) References Cited

U.S. PATENT DOCUMENTS

| | | | | |
|---|---|---|---|---|
| 3,130,570 | A | 4/1964 | Rentzepis | |
| 6,214,199 | B1 | 4/2001 | Izumi et al. | |
| 6,363,951 | B1 * | 4/2002 | Wood | 134/102.2 |
| 2003/0080068 | A1 | 5/2003 | Koslow et al. | |

FOREIGN PATENT DOCUMENTS

| | | | |
|---|---|---|---|
| DE | 2 016 831 | | 10/1971 |
| DE | 32 32 057 | | 3/1984 |
| EP | 358279 | A1 * | 3/1990 |
| EP | 0 777 998 | | 6/1997 |
| JP | 1-101469 | U | 7/1989 |
| JP | 2-148660 | U | 12/1990 |
| JP | 10-14844 | A | 1/1998 |
| JP | 2003-144372 | | 5/2003 |
| WO | WO 2005/063109 | | 7/2005 |

OTHER PUBLICATIONS

Machine Translation of Omachi. JP 2003-144372, May 2003.*
Machine Translation of Fried et al. (EP 0358279), Mar. 1990.*
International Search Report PCT/EP2005/055330.

* cited by examiner

*Primary Examiner* — Michael Barr
*Assistant Examiner* — David Cormier
(74) *Attorney, Agent, or Firm* — James E. Howard; Andre Pallapies

(57) ABSTRACT

A dishwashing machine is provided with a washing compartment, an ozone generator, and devices for washing items to be washed using a washing solution, as well as with a storage device that is connected to the washing compartment in an air-conducting manner. The storage device serves, on the one hand, to store ozone and/or hydroxyl radicals as they form or are produced and, on the other hand, to release ozone and/or hydroxyl radicals during a partial program step drying and/or a non-operating phase of the dishwashing machine whereby effecting a deodorizing.

1 Claim, 1 Drawing Sheet

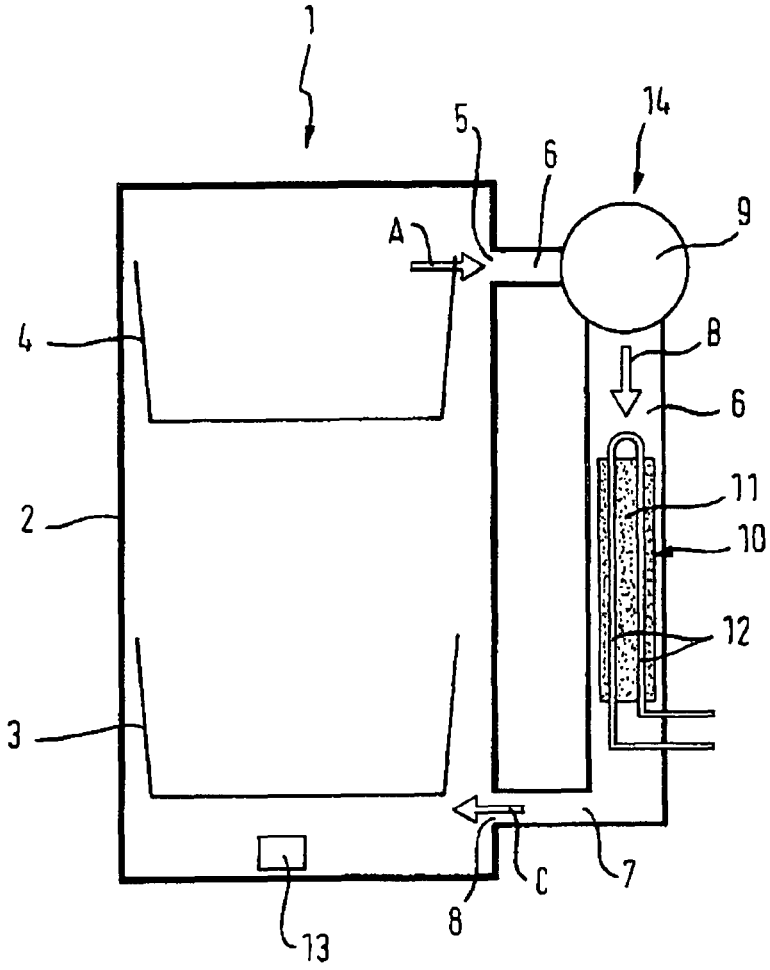
1
5
6
14
9
A
4
B
6
11
2
10
12
3
C
7
8
13

DISHWASHING MACHINE EQUIPPED WITH AN OZONE STORAGE DEVICE

The invention relates to a dishwashing machine with a washing compartment, an ozone generator and devices for washing items to be washed using a washing solution. The invention also relates to a method for operating such a dishwashing machine.

As is well known conventional dishwashing machines have a washing process whose programme sequence generally consists of at least one "Prewash" partial programme step, a "Clean" partial programme step, at least one "Intermediate Wash" partial programme step, a "Clear Wash" partial programme step and a "Drying" partial programme step. In order to increase the cleaning effect the washing liquid (washing solution) is in this case heated before or during a partial programme step. The washing liquid is normally heated by means of electrical heating systems. Different drying systems are known for drying the items to be washed in a dishwashing machine, among other things the use of so-called sorption drying devices.

A dishwashing machine with such a drying system is disclosed in DE 20 16 831. In this system a compartment connected to the interior of the washing compartment by a sealable opening is mounted on a wall of the washing compartment for receiving a drying means which is capable of absorbing moisture and discharging it again on heating.

In dishwashing machines the problem generally arises that when the door is opened there is an odour, unpleasant to the user, resulting from prolonged non-operating time during which dirty items to be washed are arranged in the dishwashing machine.

The object of this invention is therefore to provide a dishwashing machine and a method for operating the same with which it is possible to avoid such a situation.

This object is achieved by a dishwashing machine according to the features of claim 1 and by a method according to the features of claim 6. Advantageous designs are described in each of the dependent claims.

In the dishwashing machine according to the invention, with a washing compartment, an ozone generator and devices for washing items to be washed by means of washing solution, the dishwashing machine has a storage device connected in an air-conducting manner to the washing compartment for ozone and/or hydroxyl radicals, which device preferably serves on the one hand to receive ozone and/or hydroxyl radicals during its production or formation, and on the other hand to discharge ozone and/or hydroxyl radicals during a "Drying" partial programme step and/or during a non-operating phase of the dishwashing machine. The advantage of such a storage device for receiving ozone and/or hydroxyl radicals is that ozone and/or hydroxyl radicals can be fed into the washing compartment of the dishwashing machine at certain specified times in order to prevent the formation of an unpleasant odour, thereby improving the hygiene of the interior of the washing compartment even during prolonged non-operating phase.

In a suitable design an ozone generator is provided for this purpose which generates ozone and introduces it into the washing solution during a partial programme step of a washing programme in which the crockery and cutlery are subjected to the action of washing solution. For this purpose the ozone generator can be arranged in the interior of the washing compartment, for example so that it can the introduce ozone ($O_3$) during a "Clean" and/or "Clear Wash" partial programme step. The ozone dissolved in the washing solution serves initially and advantageously to increase the cleaning action of the partial programme step concerned. Because of the permanent circulation of the washing solution some of the ozone which can be supplied to the storage device and can be stored in it gasifies so that it can then be discharged during a "Drying" partial programme step and/or a non-operating phase of the dishwashing machine. Since the discharge takes place at a time when the dishwashing machine is not loaded with any washing solution, the ozone serves to deodorise the washing compartment and/or the items to be washed in it. The storage device is also able to store hydroxyl radicals which have the same effect. Hydroxyl radicals are formed in the dishwashing machine in the washing solution and can also be fed to the storage device according to the invention.

According to a suitable design a fan is provided which can be activated by a control system in order to introduce the ozone and/or the hydroxyl radicals into the storage device and remove the ozone and/or the hydroxyl radicals from the storage device.

According to a further design the fan can be activated by the control system during the non-operating phase, the activation taking place periodically or as a reaction to the opening or closing of a door contact of a door of the dishwashing machine. This ensures that the washing compartment and/or the items to be washed are deodorised even during a prolonged non-operating phase when the ozone and/or the hydroxyl radicals stored in the storage device are fed into the washing compartment by operating the fan.

According to a further design the storage device is formed by a sorption column containing reversibly dehydratable material. Zeolith in particular may be used as reversibly dehydratable material. Dishwashing machines with such a sorption column are known in principle from the state of the art and are used for drying the cutlery and crockery during the "Drying" partial programme step. In order to effect deodorisation of the washing compartment and/or of the items to be washed, only an ozone generator need therefore be provided in such a dishwashing machine for the sorption drying device already present in order initially to introduce the ozone into the washing solution and then to feed the proportion of the ozone gasified during circulation into the storage device and to store it there.

The particular advantage of the invention consists in the fact that only a fan need be operated for deodorising the washing compartment and/or the items to be washed during a non-operating phase, i.e. at times when the dishwashing machine itself is out of operation, which fan is operated for short times and/or periodically. The advantage of this over operating an ozone generator during such a non-operating phase is that only a small quantity of energy is consumed during this non-operating phase.

In the method according to the invention for operating a dishwashing machine with a washing compartment, an ozone generator and devices for washing items to be washed by means of washing solution, a fan is operated during a period outside a partial programme step of a washing programme in which the items to be washed are acted upon with washing solution, in order to feed ozone and/or hydroxyl radicals stored in a storage device into the washing compartment of the dishwashing machine. The ozone and/or hydroxyl radicals present in the storage device are consequently discharged from it when the fan is put into operation. As described above, a reversibly dehydratable material, e.g. zeolith, is preferably used here as the storage device, which material is able to absorb moisture with the formation of condensation heat and discharge the moisture stored in it again during heating. Independently of these properties, the reversibly dehydratable material is capable of storing ozone and/or hydroxyl radicals intermediately and discharging it/them by generating an air flow so that it/them can be fed into the washing compartment or onto the items to be washed for deodorisation.

According to an advantageous variant of the method according to the invention ozone is introduced into the washing solution in a partial programme step in which the items to be washed are acted upon by washing solution, and the fan is operated in order to feed ozone gasified and/or hydroxyl radicals formed during this partial programme step into the storage device connected in an air-conducting manner to the washing compartment.

The ozone is introduced into the washing solution according to a further advantageous variant using an ozone generator.

According to a further preferred design of the method according to the invention the fan is operated during a non-operating phase of the dishwashing machine in order to introduce the ozone and/or the hydroxyl radicals into the washing compartment to avoid a fermenting, musty odour. A non-operating phase is understood to mean a condition of rest of the dishwashing machine. Alternatively it would also be conceivable to feed the ozone and/or hydroxyl radicals stored intermediately in the storage device into the washing compartment of the dishwashing machine even during the "Drying" partial programme step.

It is also advantageous to operate the fan at periodical intervals to achieve the desired deodorisation. The periodic operation of the fan, preferably for a short time only, also ensures low energy consumption of the dishwashing machine.

It is also preferably for the fan to be operated as a reaction of the opening or closing of a door of the dishwashing machine. It must be assumed, for example, that new, dirty items to be washed have been introduced into the washing compartment after the dishwashing machine is opened and closed. The fan can be put into operation with a predetermined time offset in order to neutralise the odours deriving from the newly added dirty items to be washed.

The invention is explained in further detail below by way of the exemplary embodiment of a dishwashing machine according to the invention shown in the drawing.

The single FIGURE shows in a diagrammatic representation a dishwashing machine 1 according to the invention, with a washing compartment 2 in which crockery baskets 3, 4 are arranged for the introduction of items to be washed, not shown. The dishwashing machine according to the invention is equipped with a sorption drying device 14 that is known in principle from the state of the art. For this purpose dishwashing machine 1 has a sorption column 10 connected in an air-conducting manner to washing compartment 2 and containing reversibly dehydratable material 11, e.g. zeolith, wherein sorption column 10, as will be explained in more detail below, is used on the one hand for drying and on the other hand for heating air that is fed through.

Washing compartment 2 has an outlet 5, arranged in the exemplary embodiment described in its upper region, with a pipe 6 to sorption column 10 and an inlet 8 arranged in the exemplary embodiment described in its lower region, with a pipe 7 from sorption column 10. In pipe 6 to sorption column 10 is arranged a fan 9 which feeds air from washing compartment 2 to sorption column 10. In the closed air system contaminated an exchange of contaminated air from the atmosphere is totally excluded, thereby preventing recontamination of the items processed.

A heating element 12, which is electric in the exemplary embodiment shown, is arranged in sorption column 10 of desorption of the reversibly dehydratable material. The operation of such a sorption drying device 14 is known in principle from the state of the art, e.g. DE 20 16 831 or DE 103 53 774.09 and/or DE 103 53 775.9, so that a more detailed statement is dispensed with at this point with reference to the disclosures therein. The content of applications DE 103 53 774.0 and/or DE 103 53 775.9 of the applicant is also incorporated in this application, if appropriate.

According to the invention an ozone generator 13 is also provided in washing compartment 2, which generator can in principle be arranged at any point in the washing compartment. Ozone generator 13 is operated with circulating washing solution during a partial programme step so that it discharges ozone produced by it into the washing solution to increase its cleaning action. Some of the ozone gasifies due to circulation of the washing solution through devices not shown in detail for washing the items to be washed. Fan 9 is therefore operated during circulation of the washing solution mixed with ozone so that this gasified ozone and hydroxyl radicals formed in the washing solution are conducted through outlet 5 and pipe 6 in the direction of sorption column 10. Sorption column 10 containing reversibly dehydratable material 11 serves as an intermediate storage device for the ozone and/or the hydroxyl radicals.

Since the unpleasant, fermenting and musty odours are not formed immediately after the end of the washing programme, but due to dirty items to be washed introduced into washing compartment 2, fan 9 is operated in a time-offset manner, e.g. as a reaction to the opening and closing of the door (not shown) of dishwashing machine 1. Here it is sufficient for fan 9 to be operated only for a short time in order to feed only a proportion of the ozone and/or hydroxyl radicals stored in sorption column 10 via pipe 7 and inlet 8 into washing compartment 2.

In another variant fan 9 could be operated at periodic intervals independently of the times of the opening and closing of the door of the dishwashing machine.

In a further variant it is also conceivable to feed some of the ozone and/or hydroxyl radicals stored in sorption column 10 into the washing compartment during the "Drying" partial programme step in order to provide deodorisation even at this point and hence improve hygiene in the washing compartment and/or items to be washed.

Contrary to the variant described and shown in the FIGURE, it is also possible, in a further variant, to operate the sorption column serving as the storage device, independently of the function of the latter, for accelerating the drying process during a "Drying" partial programme step. In this variant the provision of heating element 12 in or near sorption column 10 would be unnecessary.

Another suitable storage device for the intermediate storage of ozone and/r hydroxyl radicals is also conceivable.

With this invention a dishwashing machine is provided with which it is possible to keep the interior of the washing compartment hygiene and/or store the items to be washed hygienically even during a prolonged non-operating phase, since the ozone discharged into the interior of the washing compartment disinfects the air. Because of the low doses the ozone cannot be identified by a user.

LIST OF REFERENCE SYMBOLS

1 Dishwashing machine
2 Washing compartment
3 Crockery basket
4 Crockery basket
5 Outlet
6 Pipe

7 Pipe
8 Inlet
9 Fan
10 Sorption column
11 Reversibly dehydratable material
12 Heating element
13 Ozone generator
14 Sorption drying device
A, B, C Air path

The invention claimed is:

1. A method for operating a dishwashing machine with a washing compartment, an ozone generator and devices for washing items to be washed by means of washing solution, the method comprising:

applying a washing solution to items to be washed during a partial programme step of a washing programme; and operating a fan during a period that does not coincide with the period of the partial programme step of a washing programme in which the items to be washed are acted upon by washing solution, the fan promoting the feed of at least one of ozone and hydroxyl radicals stored in a storage device from the storage device into the washing compartment of the dishwashing machine, wherein the step of operating a fan during a period that does not coincide with the period of the partial programme step of a washing programme includes operating the fan during a phase of the dishwashing machine when the washing programme is not running;

wherein the step of operating a fan during a period that does not coincide with the period of the partial programme step of a washing programme includes switching on the fan at periodic intervals.

* * * * *

UNITED STATES PATENT AND TRADEMARK OFFICE

CERTIFICATE OF CORRECTION

PATENT NO. : 8,440,026 B2
APPLICATION NO. : 11/791396
DATED : May 14, 2013
INVENTOR(S) : Classen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 774 days.

Signed and Sealed this
Eighth Day of September, 2015

Michelle K. Lee

Michelle K. Lee
*Director of the United States Patent and Trademark Office*